US006071041A

United States Patent [19]

Knight

[11] Patent Number: 6,071,041

[45] Date of Patent: Jun. 6, 2000

[54] REVETMENT BLOCK

[75] Inventor: David W. Knight, Humble, Tex.

[73] Assignee: Petratech, Inc., Bloomington, Minn.

[21] Appl. No.: 09/179,651

[22] Filed: Oct. 27, 1998

[51] Int. Cl.[7] ..... E02B 3/12; E01C 5/00

[52] U.S. Cl. ..... 405/16; 405/19; 405/20; 404/40; 404/41; 52/604

[58] Field of Search ..... 405/15, 16, 17, 405/18, 19, 20, 21, 35; 404/40, 41, 42, 34, 39; 52/603, 604, 605

[56] References Cited

U.S. PATENT DOCUMENTS

| | | | |
|---|---|---|---|
| Re. 32,663 | 5/1988 | Atkinson . | |
| 451,466 | 5/1891 | Drake | 52/604 X |
| 472,590 | 4/1892 | Simpson | 404/41 |
| 2,368,330 | 1/1945 | Schwartz | 404/41 |
| 3,416,276 | 12/1968 | Caputo et al. . | |
| 3,873,225 | 3/1975 | Jakobsen et al. | 404/41 |
| 4,227,829 | 10/1980 | Landry, Jr. . | |
| 4,370,075 | 1/1983 | Scales . | |
| 4,375,928 | 3/1983 | Crow et al. . | |
| 4,436,447 | 3/1984 | Crowe . | |
| 4,465,398 | 8/1984 | Knudsen | 405/16 |
| 4,497,858 | 2/1985 | Dupont et al. . | |
| 4,661,012 | 4/1987 | McCloskey . | |
| 4,850,739 | 7/1989 | Gargollo | 404/41 |
| 4,875,803 | 10/1989 | Scales . | |
| 5,020,938 | 6/1991 | Scales | 405/16 |
| 5,133,620 | 7/1992 | Scheiwiller . | |
| 5,222,342 | 6/1993 | Defferrari | 52/604 X |
| 5,429,451 | 7/1995 | Pettee, Jr. . | |
| 5,484,230 | 1/1996 | Rudloff . | |
| 5,556,228 | 9/1996 | Smith . | |
| 5,779,391 | 7/1998 | Knight . | |
| 5,902,069 | 5/1999 | Barth et al. | 405/37 |
| 5,906,456 | 5/1999 | Knight | 405/20 |
| 5,921,710 | 7/1999 | Scales | 405/20 |

OTHER PUBLICATIONS

Koutsourais, "A Study of Articulated Concrete Blocks Designed to Protect Embankment Dams", Petraflex Case History, 2 pages, 1994.

Petraflex/Keystone Protect Lakeshore for New Park, Petraflex Case Study: Lakeshore Revetment, 1 page, 1996.

Armorloc3510/4511, "The Precast Concrete Interlocking Erosion Control Block", 2 pages, 1994.

Conlock, "World's Most Advanced, Versatile, Economical, Precast, Concrete Interlocking Erosion Control Systems", 4 pages, 1995.

Hydro–Turf & Assoc., Inc. Advertisement, undated.

Channel–Lock™, "Flexible Concrete Revetment", 4 pages, undated.

*Primary Examiner*—Eileen Dunn Lillis
*Assistant Examiner*—Jong-Suk Lee
*Attorney, Agent, or Firm*—Popovich & Wiles, PA

[57] ABSTRACT

A block for use in a revetment system comprising a plurality of blocks arranged to form a mat. The block has a top surface, a bottom surface and first and second opposed side surfaces that extend between the top and bottom surfaces, and third and fourth opposed side surfaces extending between the top and bottom surfaces and the first and second side surfaces. The first and second opposing side surfaces have a mating recess and projection, such that a recess on a first side surface mates with a projection on a second side surface of an adjacent block in a revetment system. On each of the third and fourth sides is a channel and two interlocking tips disposed on either side of the channel. The interlocking tips of a third or fourth side of one block are adapted to fit into the channel of the third or fourth side of another block. The channel is configured so that there is the possibility of lateral movement when the blocks are configured into a mat.

12 Claims, 3 Drawing Sheets

REVETMENT BLOCK

FIELD OF THE INVENTION

The present invention relates to an improved revetment block for use in a system of interlocking modular concrete blocks used in a matrix to control soil erosion in applications where moving water is present. The system may be used to control erosion in a variety of settings where water moves across or against the sides or bottom of a channel, embankment or shoreline. The system may be installed above or below the waterline.

BACKGROUND OF THE INVENTION

The use of articulating block matrices for soil erosion prevention is known in the art. Typically, such systems involve the grading of an embankment or shoreline to a predetermined slope, the installation of a highly water permeable geosynthetic fabric over the soil substrate, and then the placement over the fabric of a matrix of blocks. A typical matrix of blocks is comprised of precast concrete blocks. Such blocks may be tied together into mats with cables usually comprised of high strength polyester or galvanized steel. Alternatively, the formation of the matrix may rely soley on the interlock provided by the block's design. Cabled mats are typically assembled off-site at a block precasting facility. After the blocks are cast, cables are strung through tunnels in the blocks, typically producing mats that are approximately 8 feet wide and 40 feet long. Mats of this size have proven convenient for handling and transporting to the job site. The assembled mats are lifted onto a truck or barge for transportation to the job site using a crane or large forklift truck equipped with a spreader bar assembly which suspends the mats in a generally horizontal orientation. At the installation site, the mats are placed side by side by a crane using a spreader bar assembly. The cables of adjacent mats are bonded together so that the finished installation comprises a continuous matrix of concrete blocks. Alternatively, the blocks may be placed individually and, if desired, cabled together after they are laid into a matrix.

The resulting surface may have openings between the blocks and/or in the blocks that may be backfilled with soil and seeded to produce vegetation. The presence of vegetation produces an aesthetically appealing shoreline and also provides greater resistance to erosion.

A revetment system constructed in this manner relies on the combination of the permeable fabric and the articulating concrete block surface to overcome the erosive effects of flowing water or waves to hold in place the underlying soil. Such systems have been widely used, and there are numerous examples of revetment systems that operate in the general fashion described above, including those described in U.S. Pat. No. 4,227,829 (Landry), U.S. Pat. No. 4,370,075 (Scales) and systems such as that marketed by Petratech, Inc. under the tradename PETRAFLEX™ Revetment System and that marketed by Nicolon Corporation under the trade designation ARMORLOC.

The revetment system described in the Landry patent is referred to as a "dual cable system" because one set of cables passes through the entire transverse dimension of the matrix and another set passes through the entire longitudinal dimension of the matrix. The blocks have angular tapered sides such that the top surface of the block has less surface area than the bottom surface, to facilitate articulation of the matrix over non-planar surfaces and bowing of the matrix when it is suspended from a spreader bar assembly.

The revetment system described in Scales is also a matrix of blocks placed in parallel transverse rows, with cable interconnections. The blocks also have angular tapered sides to facilitate articulation. Unlike Landry, the revetment system described in Scales uses cables that travel only in the longitudinal direction and each block has two longitudinal tunnels for the cables. This system typically is referred to as a "single cable system". The blocks of Scales are of a generally rectangular shape, with recesses and protrusions in the sidewalls configured so that longitudinally adjacent blocks interlock when the blocks are placed in a "running bond" pattern in the matrix by off-setting adjacent transverse rows in the transverse direction.

In the PETRAFLEX™ System, the blocks are generally square, and are placed in parallel columns and rows with a dual cable system. Two tunnels, each accepting one cable, are used in the longitudinal direction, and one tunnel, accepting one cable, is oriented in the transverse direction. Unlike Landry, the block of the PETRAFLEX™ system has, for each pair of sidewalls, one male tab on a side opposed to one female tab on the other side to interlock adjacent blocks when placed in a matrix with parallel rows and columns of like blocks.

In the ARMORLOC system, the blocks may be generally rectangular or square and are placed in offset rows and columns. A block in this system can be held in place by interlocking with as many as four adjacent blocks.

Another important design consideration for revetment systems is their ability to allow water to flow through the surface of the concrete mats. In most settings where such systems are used, water may be present in the soil substrate underneath the layer of geotextile and the concrete block mat. Such water may be introduced through rainfall, surface flows, wave action, subsurface groundwater flows or other elements. As a result, it is highly desirable that the surface of the block matrix be permeable so that the matrix is not displaced by hydrostatic pressure or undermined by erosion caused by flows occurring in the soil substrate beneath the block matrix and geotextile. It is common practice to have open voids in the matrix consist of approximately twenty percent (20%) of the total surface of the block matrix. Such voids are located either within the blocks or in the spaces between the blocks when they are placed in the matrix. There are also instances, however, where a unit without such open voids may be desired.

While such openings are highly desirable, they do introduce an element of vulnerability to displacement of the blocks, because such voids may allow wave action or water flows to destabilize or undermine the matrix. Thus, the voids should be designed to minimize the disruptive effect of hydrodynamic forces while providing sufficient open area to allow the release of water that may accumulate beneath the surface of the matrix.

The manner in which the blocks are placed into a matrix is an important design feature of articulating block revetment systems. The art teaches the use of cables connecting the blocks and providing a block to block interlock by shaping the blocks so that they nest together when placed in a matrix. The art also includes blocks that are laid without using interconnecting cables and which rely on the block's interlock with adjacent blocks in the matrix. The dual cable systems perform well, but require additional cable over that required by the single cable systems. Systems in the art not using any cables have not performed as well as cabled systems, but may be more cost-effective for certain applications. While the use of cables is desirable for system strength and to prevent removal by vandals, blocks without cables can be hand-placed, which has advantages in certain applications. For example, for small areas, it would be advantageous to avoid the use of heavy moving equipment by simply placing the necessary blocks by hand. For larger areas where, for example, below-water installation is not necessary, a hand-placed block may be more cost effective than the placement of cabled mats.

Hand placement of the blocks, however, is an advantage if there is sufficient interlock between the blocks to hold them in place. Thus, there is a need for a block useful in a revetment system with good interlock between adjacent blocks. Such a block would provide optimal resistance to erosion and displacement due to its interlocking design. Such a block also should be able to meet the design requirements of varying site conditions, including having the necessary hydrodynamic efficiency.

SUMMARY OF THE INVENTION

In accordance with the present invention there is disclosed a block for use in a revetment system comprising a plurality of blocks arranged to form a mat. The block comprises a top surface, a bottom surface and first and second opposed side surfaces that extend between the top and bottom surfaces, and third and fourth opposed side surfaces extending between the top and bottom surfaces and the first and second side surfaces. The block is symmetrical about a mirror plane of symmetry which bisects the block through the center of the first and second sides. On each of the third and fourth sides is a channel and two interlocking tips disposed on either side of the channel. Preferably, at least a portion of the interlocking tips is tapered inwardly to permit articulation of the block when in a revetment mat. The interlocking tips of a third or fourth side of one block are adapted to fit into the channel of the third or fourth side of another block. The channel is configured so that there is the possibility of lateral movement when the blocks are configured into a mat.

The first and second opposing side surfaces have a mating recess and projection, such that a recess on a first side surface mates with a projection on a second side surface of an adjacent block in a revetment system which comprises a plurality of the blocks arranged to form a mat. The blocks may be arranged in either parallel rows and columns or offset rows and columns. When arranged in offset columns, at least one of the interlocking tips of a third and fourth side engages with the channel of a third or fourth side of another block, thus locking the blocks into place.

The block may have at least one tunnel extending between either the first and second opposed side surfaces or the third and fourth opposed side surfaces. This enables the block to be connected to other blocks in the mat using cabling inserted through the tunnel. In some variations two or more tunnels may be provided between each of the opposed side surfaces.

The recess and projection of the first and second side surfaces extend between the top and bottom surfaces of the block. The first and second side surfaces may extend vertically or may be tapered inwardly. The side surfaces of the block intersect to form corners which may be truncated between the top and bottom surfaces.

Each block preferably includes at least one opening between the top and bottom surfaces. The openings may be shaped in the form of one or more elongate slots or may consist of a series of holes or linearly positioned holes arranged in a linear array. In a preferred embodiment, the block comprises two elongate slots.

The top and bottom surfaces of the block are substantially planar and parallel to one another.

In another embodiment the invention is a revetment system which includes a fabric sheet and a plurality of blocks arranged to form a mat. The fabric sheet is positioned between the bottom surface of the blocks in the mat and a soil substrate for the purpose of controlling soil erosion. Each block has a top surface, a bottom surface, first and second opposed side surfaces extending between the top and bottom surfaces and third and fourth opposed side surfaces extending between the top and bottom surfaces and the first and second side surfaces. The first side surface has a recess and the second side surface has a projection, sized and configured such that recess mates with a projection of an adjacent block in the mat. The third and fourth opposed side surfaces have interlocking tips and a channel adapted to engage at least one interlocking tip of an adjacent block in the mat.

In another embodiment, the bottom surface of each block has projections extending away from the bottom surface in a manner such that when the block is used in the revetment system the projections extend into the fabric sheet to increase the frictional stability of the revetment system. The projections may be in various suitable shapes, such as cones, truncated cones or elongate ridges.

Other features and advantages of the present invention will be made apparent from the following description of the drawings, the detailed description and the appended claims.

DETAILED DESCRIPTION OF THE INVENTION

The Revetment Block

Figure 1:
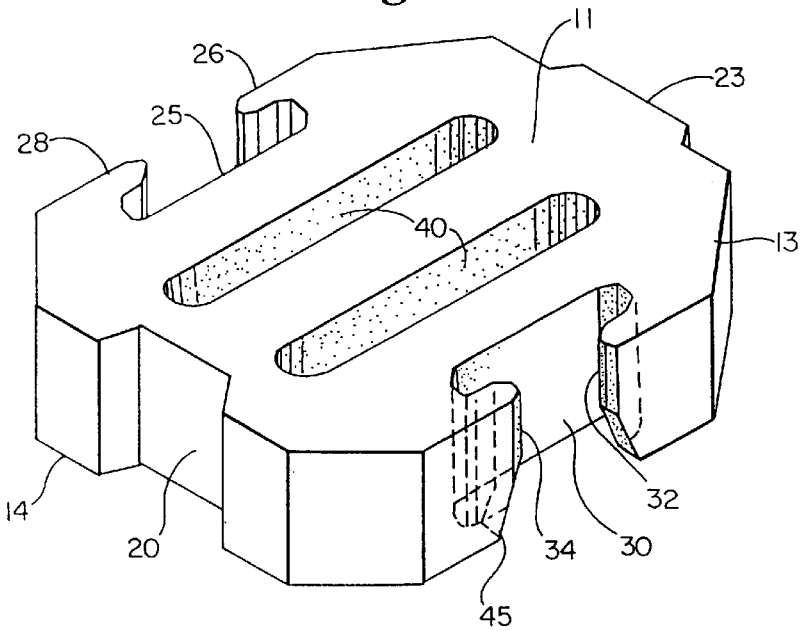
FIG. 1 is a perspective view of one embodiment of a revetment block according to the present invention.
Figure 2A:
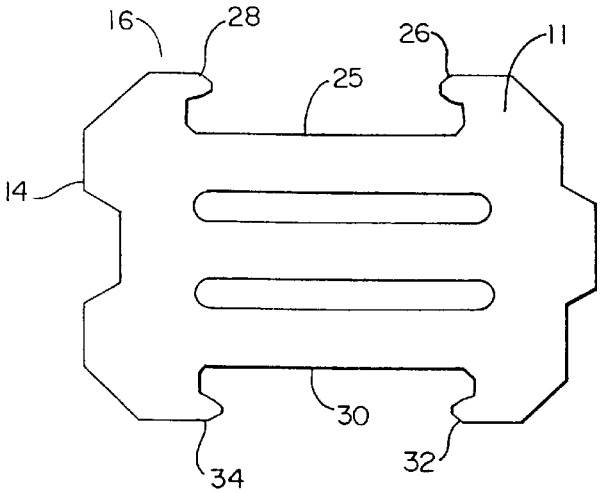
FIGS. 2A, 2B and 2C show the top view and two side views of the block of FIG. 1.
Figure 2B:
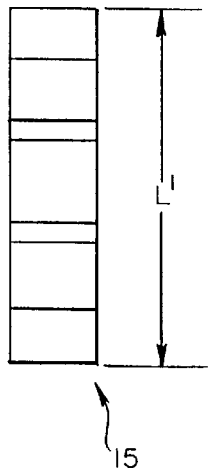
Figure 2C:
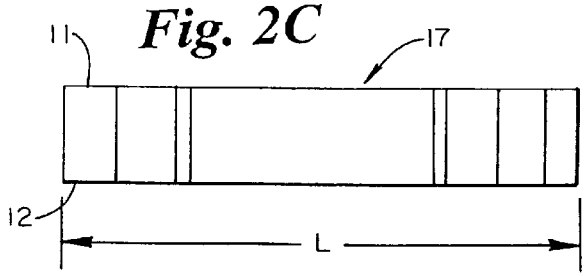

Referring now to the Figures, a precast concrete block according to the invention is shown from a perspective view in FIG. 1, and top and side views in FIGS. 2A, 2B, and 2C. In a preferred embodiment, shown generally at 1, the block has substantially planar top and bottom surfaces 11 and 12, each being spaced from and parallel to the other. The top 11 and bottom 12 are both generally rectangular, but may have truncated corners 13. Block 1 has four side surfaces extending from lateral edges of the top and bottom surfaces in two pairs of opposed side surfaces. The height of the side surfaces varies depending on site requirements. A height of 4 inches is commonly used, but in conditions involving greater hydrodynamic forces, the height may increase to more than 12 inches.

FIG. 2A illustrates that opposed side surfaces 14 and 15 are generally parallel to each other. Opposed side surfaces 16 and 17 are mirror images of each other. That is, side surfaces 16 and 17 are symmetrical about a vertical plane of symmetry which bisects the block through opposed side surfaces 14 and 15. First side surface 14 has recess 20. Second side surface 15 has projection 23. Recess 20 is opposed to and of equal proportions to projection 23. Opposing side surfaces 14 and 15 typically are vertical but may be tapered inwardly.

Figure 5:
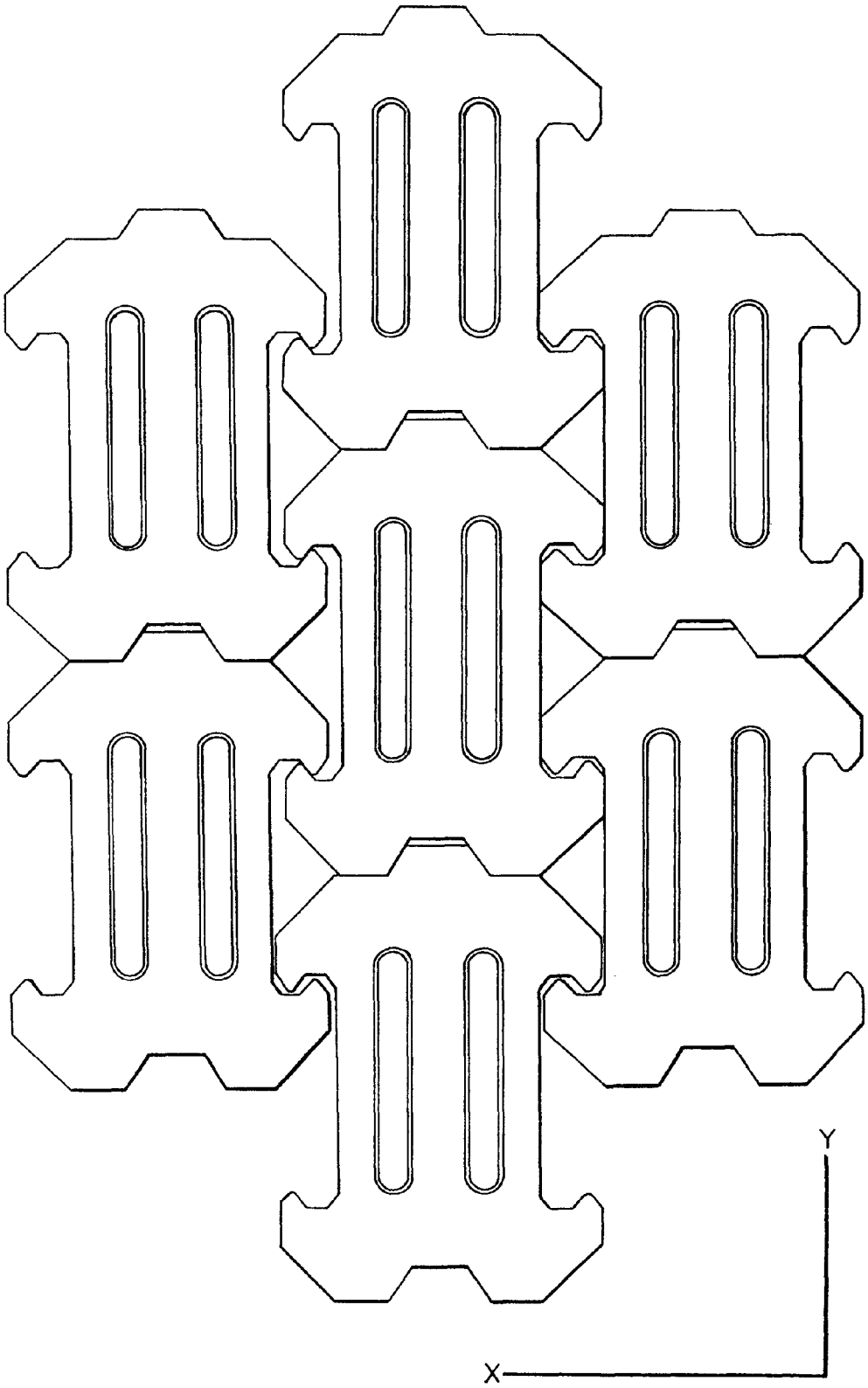
FIG. 5 is a view of a revetment mat according to the present invention.

Third side surface 16 has a central channel 25 and two interlocking tips 26 and 28. Similarly, fourth side surface 17 is of substantially identical shape to side surface 16, having a central channel 30 and two interlocking tips 32 and 34. The interlocking tips preferably are shaped and configured to fit within a channel of an adjacent block, such as the arrangement illustrated in FIG. 5. The size and shape of the tip relative to the channel preferably permits some displacement of a block in the X direction, as indicated in FIG. 5. Preferably the interlocking tip is angled but it could be curvilinear.

Figure 4:
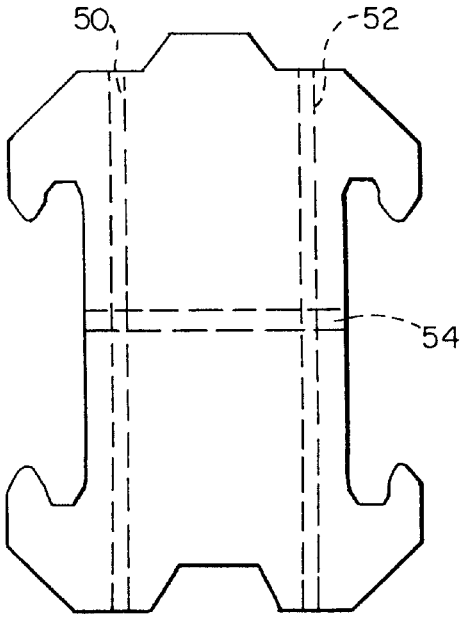
FIG. 4 shows the top view of the block of FIG. 3.

Preferably, block 1 has one or more through-holes, voids, or slots 40 which are open from the top surface 11 through bottom surface 12. More preferably, block 1 has two elongate slots, the long dimension of which runs parallel to third and fourth side surfaces 16 and 17, as shown in FIGS. 1 and 2. The slot is then referred to as running parallel to the third and fourth side surfaces. Such slots or void spaces permit water flow and growth of vegetation through the blocks. Alternatively, as shown in FIG. 4, the revetment block can be a solid block.

Recess 20 and projection 23 may extend vertically between the top and bottom surfaces or may be tapered inwardly. They are of equal proportions. This configuration allows projection 23 on one surface to mate with recess 20 on the opposite side surface of an adjacent block in the revetment mat. Additionally, this configuration allows maximum design flexibility since the blocks will interlock when the revetment mat is formed of blocks in either a parallel column and row configuration or a running bond configuration, as shown in FIG. 6, and discussed further below. Recess 20 and projection 23 may be curvilinear, angled, "u" shaped, "v" shaped or otherwise configured so that they are symmetrical about a central vertical plane perpendicular to side surfaces 14 and 15. This vertical plane is a mirror plane which bisects the block through the midpoint of side surfaces 14 and 15.

Sides 16 and 17 have channels 25 and 30, respectively, and interlocking tips 26 and 28, and 32 and 34, respectively. Channels 25 and 30 typically extend vertically between the top and bottom surfaces. Interlocking tips 26 and 28 may extend vertically between the top and bottom surfaces but preferably are tapered inwardly as illustrated by taper 45 in FIG. 1. The taper is configured such that the bottom surface of the block has a smaller surface area than the top surface of the block. The taper may be a curve having a single radius, a curve having multiple radii, or a logarithmic curve. These tapered portions allow some movement of the mat when placed over non-planar surfaces. The tapered portions also can help avoid breakage in the blocks if there is movement or shifting of the surface after the mat is in place.

Channels 25 and 30 are typically curvilinear but may have other shapes suitable to be adapted to engage the interlocking tips on an adjacent block, as illustrated in FIG. 5. The interlocking arrangement shown in FIG. 5 is a preferred embodiment for the revetment mat of this invention. The blocks are held in place by the mating of the recess and projection of the first and second sides of the blocks, as well as by the interlocking tips engaging the channels of the third and fourth sides. Thus, each block is interlocked with blocks adjacent side surfaces 14 and 15 and with two blocks in each adjacent row. Therefore, each block is interlocked with each of the six blocks adjacent to it. In this arrangement, there is sufficient space in channel 25 or 30 to permit lateral movement of the blocks (i.e., movement in direction X, as shown on FIG. 5). Movement in the Y direction is restricted, due to the interlocking blocks. Thus the design permits sufficient interlock so that a cable connection is not necessary and the blocks can be put into position by hand. The lack of a need for a cable connection is particularly desirable for situations in which the blocks are most effectively placed one at a time.

One or more cables may be used with the blocks by providing one or a plurality of passageways or tunnels through the block through which cable(s) can be threaded. Such cables serve to hold the blocks in place when forming a revetment mat, and can be useful in forming sections of mat which are then laid in place.

Blocks of the present invention may use various dimensions, but a side length L, as shown in FIG. 2B, of approximately 17 inches and side length L', as shown in FIG. 2C, of approximately 15 inches has been found convenient for optimizing manufacturing and installation efficiencies.

Figure 3:
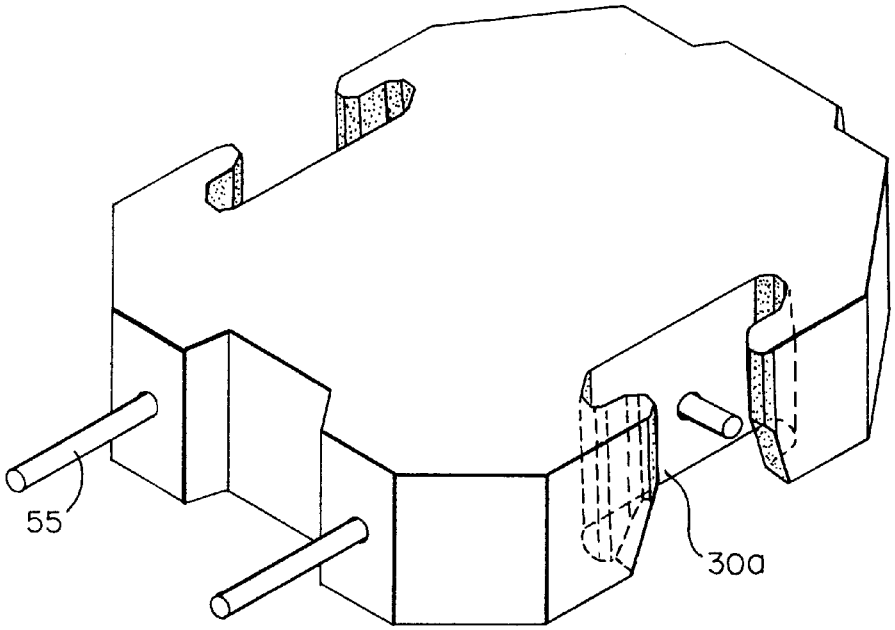
FIG. 3 is a perspective view of another embodiment of a revetment block according to the present invention.

FIG. 3 shows alternate variations for some of the features of the block of FIG. 1. In FIG. 3, the block is solid, that is, without slots 40 as shown in FIG. 1. This block also does not show tapers 45 on the interlocking tips. FIG. 3 shows tunnels for the placement of cables. The use of cables with these blocks is optional.

If cables are used, they are put into position after the blocks are laid in place. As shown in FIGS. 4 and 5, the blocks may have tunnels 50, 52, and 54 which penetrate the side surfaces and pass horizontally through the blocks in both directions to allow the blocks to be connected by passing one or more cables 55 through them. FIGS. 3 and 4 illustrate a block having two tunnels 50 and 52 between the first and second opposed side surfaces. Third tunnel 54 is shown located at the midpoint of channel 30*a*. The location and number of the cables may be altered depending upon the desired arrangement. That is, the third and fourth opposed side surfaces could have two or three tunnels. Cable tunnels typically are located at a height near midway between the top and bottom though the height of the tunnels may vary. Transverse and longitudinal tunnels are located vertically relative to one another such that they do not intersect.

In the blocks of this invention, it may be desirable to place projections or ridges on the bottom (i.e., surface 12) of the block. Projections may be in the shape of cones, truncated cones, or ridges, such as elongate ridges. Projections are thought to increase the stability of the revetment mat by protruding into the fabric sheet covering the soil substrate. The projections increase the shear resistance of the system allowing it to remain in proper position even though substantial shear forces may exist at the interface of the system with the soil substrate due to forces of water and gravity.

The Figures illustrate that these features may be present in various combinations or, may be omitted, all within the s cope of the present invention.

Assembly of Revetment Mats

An advantage of the revetment blocks of this invention is that they may be positioned by hand at the job site. They also may be connected together by one or more cables on-site.

FIG. 5 illustrates how a mat is assembled in the field. FIG. 5 shows an off-set or running bond pattern. In this configuration, blocks in each column are aligned so that the projections on the side wall facing adjacent blocks in the column mate with the recesses of adjacent blocks in the column. Since the blocks in the columns are off-set, the interlocking tips of the third and fourth side walls engage the channel of a block in an adjacent row.

If cables are used to join blocks together when making a mat, it may be desirable to employ a cable tunnel sleeve insert having a circumferential lip. Such is disclosed in U.S. Pat. No. 5,779,391 (Knight), hereby incorporated herein by reference. The sleeve is inserted into each end of each tunnel which is to receive a cable. The inserts may be comprised of a rigid material such as metal, polyvinyl chloride, polyurethane, nylon or plastic. The sleeves serve to protect the cable from abrasion and consequent breakage which tends to occur in areas where the cable exits the tunnels. The sleeve may be sized so that it is inserted into the tunnel at each end of the block for a distance of at least ¾ inch and no more than half the length of the tunnel.

Although a particular embodiment of the invention has been disclosed herein in detail, this has been done for the purposes of illustration only, and is not intended to be limiting with respect to the scope of the appended claims. It is contemplated that various substitutions, alterations, and modifications may be made to the embodiment of the invention described herein without departing from the spirit and scope of the invention as defined by the claims.

What is claimed is:

1. A block for use in a revetment system which includes a plurality of blocks arranged to form a mat, the block comprising:

a top surface;

a bottom surface;

first and second opposed side surfaces extending between the top and bottom surfaces, the first side surface having a recess and the second side surface having a projection, such that the recess is sized and configured to mate with the projection of an adjacent block in the mat; and third and fourth opposed side surfaces extending between the top and bottom surfaces and the first and second side surfaces, each of the third and fourth side surfaces having two interlocking tips and a channel, the channel adapted to engage an interlocking tip of a first adjacent block in the mat and an interlocking tip of a second adjacent block in the mat, the channel and the interlocking tips being configured to permit relative movement between the block and the first and second adjacent blocks while maintaining an interlocking relationship between the block and the first and second adjacent blocks.

2. The block of claim 1 further including at least one opening between the top and bottom surfaces.

3. The block of claim 2 wherein the at least one opening is shaped in the form of an elongate slot.

4. The block of claim 3 wherein the elongate slot is parallel to the third and fourth side surfaces and perpendicular to the first and second side surfaces.

5. The block of claim 1 further including at least one tunnel extending between the first and second opposed side surfaces.

6. The block of claim 1 further including a plurality of tunnels including at least one tunnel extending between the first and second opposed side surfaces and at least one tunnel extending between the third and fourth opposed side surfaces.

7. The block of claim 6 wherein the plurality of tunnels includes a plurality of tunnels extending between the first and second opposed side surfaces and a plurality of tunnels extending between the third and fourth opposed side surfaces.

8. The block of claim 1 wherein the interlocking tips include a portion which is tapered inwardly towards the bottom surface such that the area of the bottom surface is less than the area of the top surface.

9. The block of claim 1 wherein the recesses and projections extend vertically between the top and bottom surfaces.

10. The block of claim 1 wherein the interlocking tips and channels extend vertically between the top and bottom surfaces.

11. The block of claim 1 wherein the side surfaces intersect to form corners and wherein each of the corners is truncated between the top and bottom surfaces.

12. A revetment system which comprises a plurality of blocks arranged to form a mat, each block having a top surface, a bottom surface, first and second opposed and substantially parallel side surfaces extending between the top and bottom surfaces, the first side surface having a recess and the second side surface having a projection, the projection and recess being sized and configured such that the recess mates with the projection of an adjacent block in the mat, and third and fourth opposed side surfaces extending between the top and bottom surfaces and the first and second side surfaces, each of the third and fourth side surfaces having two interlocking tips and a channel, the channel adapted to engage an interlocking tip of a first adjacent block in the mat and an interlocking tip of a second adjacent block in the mat, the channel and the interlocking tips being configured to permit relative movement between the block and the first and second adjacent blocks while maintaining an interlocking relationship between the block and the first and second adjacent blocks.

* * * * *